US011145167B1

(12) United States Patent
Lemanski et al.

(10) Patent No.: US 11,145,167 B1
(45) **Date of Patent: *Oct. 12, 2021**

(54) CASINO SYSTEM AND METHOD FOR CONDUCTING A CARD GAME INCLUDING OPTIONAL MATCH AND POKER BONUS FEATURES

(71) Applicants: James E. Lemanski, Lisle, IL (US); Daryl P. Jendraszkiewicz, Aurora, IL (US)

(72) Inventors: James E. Lemanski, Lisle, IL (US); Daryl P. Jendraszkiewicz, Aurora, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/872,273

(22) Filed: May 11, 2020

Related U.S. Application Data

(63) Continuation of application No. 16/211,096, filed on Dec. 5, 2018, now Pat. No. 10,650,643.

(51) Int. Cl.

| | |
|---|---|
| ***A63F 1/00*** | (2006.01) |
| ***G07F 17/32*** | (2006.01) |
| ***G06Q 50/34*** | (2012.01) |
| *A63F 3/00* | (2006.01) |

(52) U.S. Cl.
CPC ..... *G07F 17/3293* (2013.01); *G06Q 50/34* (2013.01); *G07F 17/3244* (2013.01); *G07F 17/3262* (2013.01); *G07F 17/3267* (2013.01); *A63F 1/00* (2013.01); *A63F 3/00157* (2013.01); *A63F 2001/005* (2013.01); *A63F 2003/00164* (2013.01); *A63F 2003/00167* (2013.01)

(58) Field of Classification Search
CPC ..... A63F 1/00; A63F 2003/00164; A63F 2003/00167; A63F 3/00157; A63F 2001/005
USPC ..... 273/292, 274, 309; 463/13, 12
See application file for complete search history.

(56) References Cited

U.S. PATENT DOCUMENTS

| | | | | |
|---|---|---|---|---|
| 5,697,614 | A * | 12/1997 | Potter | A63F 3/00157 273/292 |
| 5,810,663 | A * | 9/1998 | Bochichio | A63F 1/00 273/292 |
| 6,793,220 | B1 * | 9/2004 | Feola | A63F 3/00157 273/274 |
| 8,480,465 | B2 * | 7/2013 | Ennis | A63F 1/00 463/11 |
| 10,650,643 | B1 * | 5/2020 | Lemanski | G07F 17/3293 |

* cited by examiner

*Primary Examiner* — Benjamin Layno
(74) *Attorney, Agent, or Firm* — FisherBroyles, LLP; Rob L. Phillips

(57) ABSTRACT

A system and method for conducting a card game including a player v. dealer arrangement involving a comparison of HI and LO hand values. Players declare a three-card hand as either HI or LO and a dealer forms three-card LO and HI hands using five cards with a shared card being used in both the LO and HI hand. Aces have a value of 1 point when used in a LO hand and 11 when used in a HI hand, face cards have a value of 0 points and cards 2 through 10 have values matching their rank. Match and poker bonus features may also be incorporated.

13 Claims, 9 Drawing Sheets

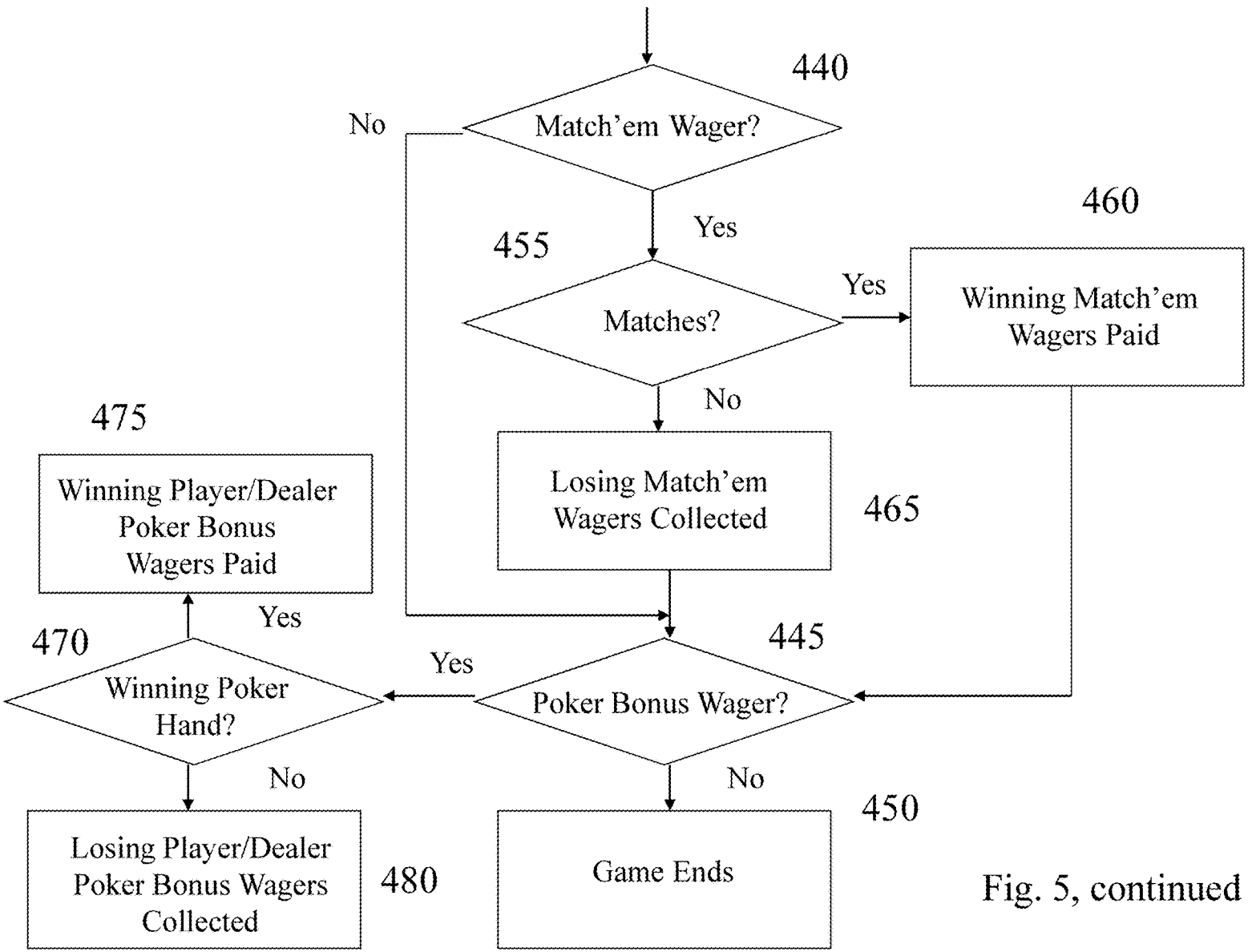
Fig. 5, continued

CASINO SYSTEM AND METHOD FOR CONDUCTING A CARD GAME INCLUDING OPTIONAL MATCH AND POKER BONUS FEATURES

CROSS-REFERENCE

This application is a continuation of U.S. patent application Ser. No. 16/211,096 filed Dec. 5, 2018 now U.S. Pat. No. 10,650,643, which is incorporated herein by reference for all purposes.

FIELD OF THE INVENTION

The embodiments of the present invention relate to a player v. dealer card game involving a comparison of HI and/or LO hands between a player's hands and a dealer's hand.

BACKGROUND

Casino floor space dedicated to live games of chance is being severely restricted and even eliminated to make room for an increasing number of profit-making electronic gaming devices, such as slot and video poker machines. While live card games, like Blackjack, Baccarat and Caribbean Stud Poker, and non-card games, like Roulette and Craps, remain popular, some casinos have removed a percentage of their Blackjack, Baccarat and Caribbean Stud Poker tables to accommodate additional electronic gaming devices. However, casinos recognize that live table games are integral to any casino since many players are not interested in playing the electronic gaming devices or machines. Some players refuse to play electronic gaming machines because the players do not trust the outcomes, and in many cases, the electronic gaming machines do not require any player skill. In addition, playing the electronic gaming machines eliminates most of the social interaction involved with playing live table games.

Thus, there is a need for new, exciting live games of chance to retain existing players and attract new players. Advantageously, the new games of chance should be playable using electronic devices including video machines, computer terminals and hand-held devices as well.

SUMMARY

Accordingly, a first embodiment of the present invention involves dealing players three face-down cards and a dealer five face-down cards after which each player declares their hand as HI or LO based on the aggregate value of the three cards. In one embodiment, Aces have a value of 1 point when used in a LO hand and 11 when used in a HI hand, face cards have a value of 0 points and cards 2 through 10 have values equivalent with their rank. Once each player declares their hand as HI or LO, the dealer turns over the five face-down cards and selects the three lowest valued of the five cards as a LO hand and places the three lowest cards in a LO hand area with the highest LO card in a shared card area such that the shared card also forms part of the HI hand with the two remaining cards (i.e., the two cards not being selected as part of the three lowest valued cards forming the LO hand). In this embodiment, players have the option of doubling their mandatory game wager after declaring their hand as HI or LO and before observing the dealer's cards.

The HI or LO value of each player's hand as declared by the player is then compared to the value of the corresponding HI or LO dealer hand.

Optional side bets, including a matching side bet, 3-card poker side bet based on the player's hand and a 5-card poker side bet based on the dealer's hand, may be incorporated into the game as well.

Other variations, embodiments and features of the present invention will become evident from the following detailed description, drawings and claims.

DETAILED DESCRIPTION

Figure 1:
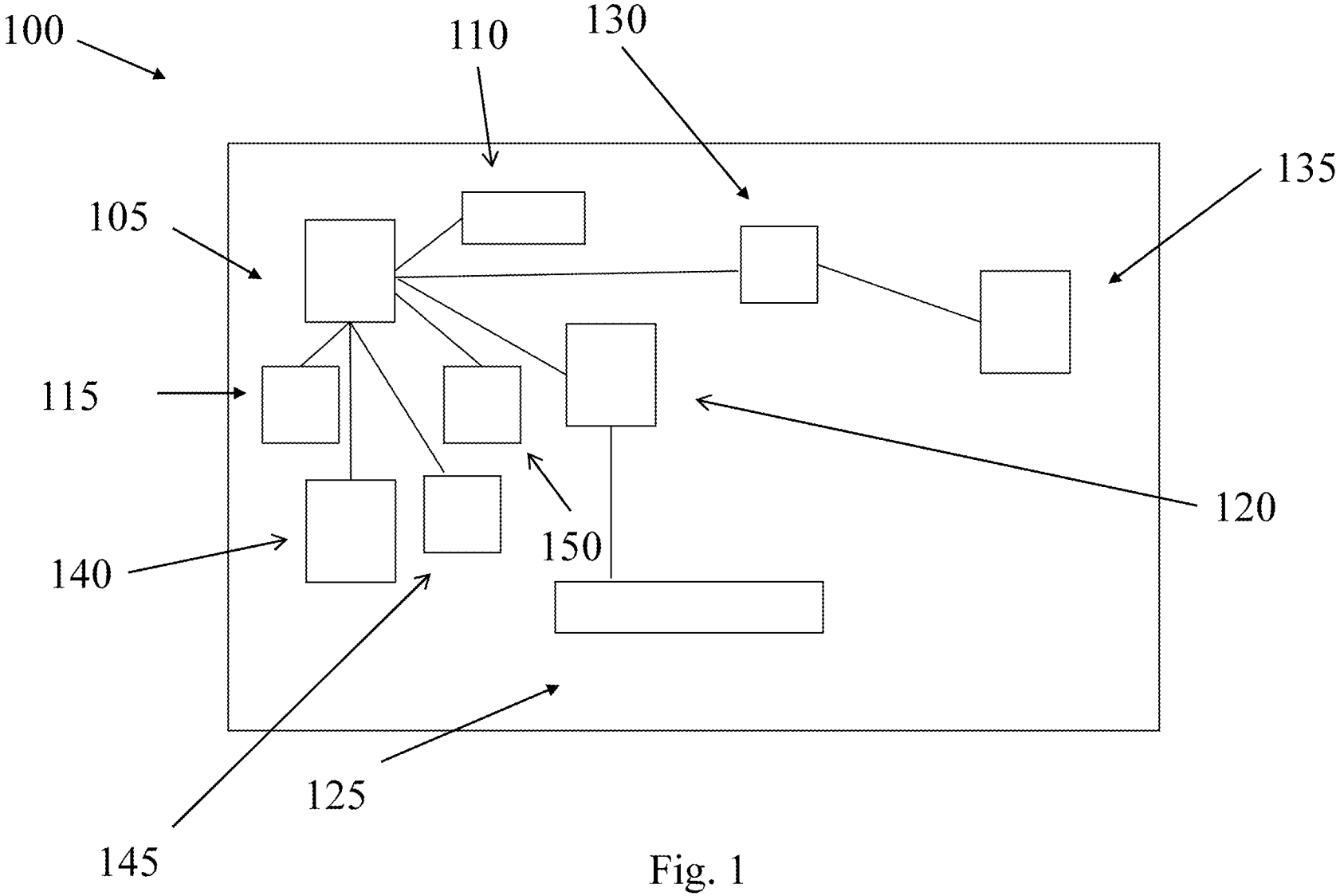
FIG. 1 illustrates a block diagram of components of an electronic gaming device for conducting a casino game according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Those skilled in the art will recognize that the embodiments of the present invention involve both hardware and software elements which portions are described below in such detail required to construct and operate a game method and system according to the embodiments of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagrams. As used herein, a "gaming device" and "gaming machine" should be understood to be any one of a general purpose computer, as for example a personal computer or a laptop computer, a client computer configured for interaction with a server, a special purpose computer such as a server, or a smart phone, tablet computer, personal digital assistant or any other machine adapted for executing programmable instructions in accordance with the description thereof set forth herein.

In addition to gaming tables, the embodiments of the present invention may be facilitated by an electronic gaming device allowing multiple players to play against one another under the control of a central server as described herein. Besides mobile devices, the electronic gaming device may be a standalone device and bar-top device forming part of a gaming device network or not. A block diagram of the electronic gaming device 100 is shown in FIG. 1. The exemplary electronic gaming device 100 may include a central processing unit (CPU) also deemed a processor 105 which controls the electronic gaming device 100 based on instructions stored in program read-only memory (ROM) 110 and pay table ROM 115. Program ROM 110 stores executable instructions related to the operation of the gaming device 100 and which are generally permanent. CPU 105 may be connected to a video controller 120 which provides output to one or more video displays 125. Similarly, an audio controller 130 provides audio output as dictated by the CPU 105 through speakers 135. The components, and others, may be attached to a circuit board forming a motherboard. In another embodiment, the electronic gaming device 100 may be linked to a central game server which allows players to select from games via the electronic gaming device 100. In such an embodiment, one or more processors integrated into the central server control the gaming device 100 based on instructions stored in program ROM 110.

A user interface 140 may respond to buttons on button panel or display incorporating touch screen technology or any other devices providing means for users to communicate with, and instruct, the electronic gaming device 100. Wager memory 145 stores an amount of money/credits deposited into the electronic gaming device 100 by a player and specific wager information related to each play of the electronic gaming device 100. Payout system 150 includes a coupon printer or similar device for receiving money/coupon from the electronic gaming device 100.

Those skilled in the art will recognize that the configuration and features of the electronic gaming device 100 disclosed herein are exemplary and may be altered in any number of ways without impacting the embodiments of the present invention.

Figure 2:
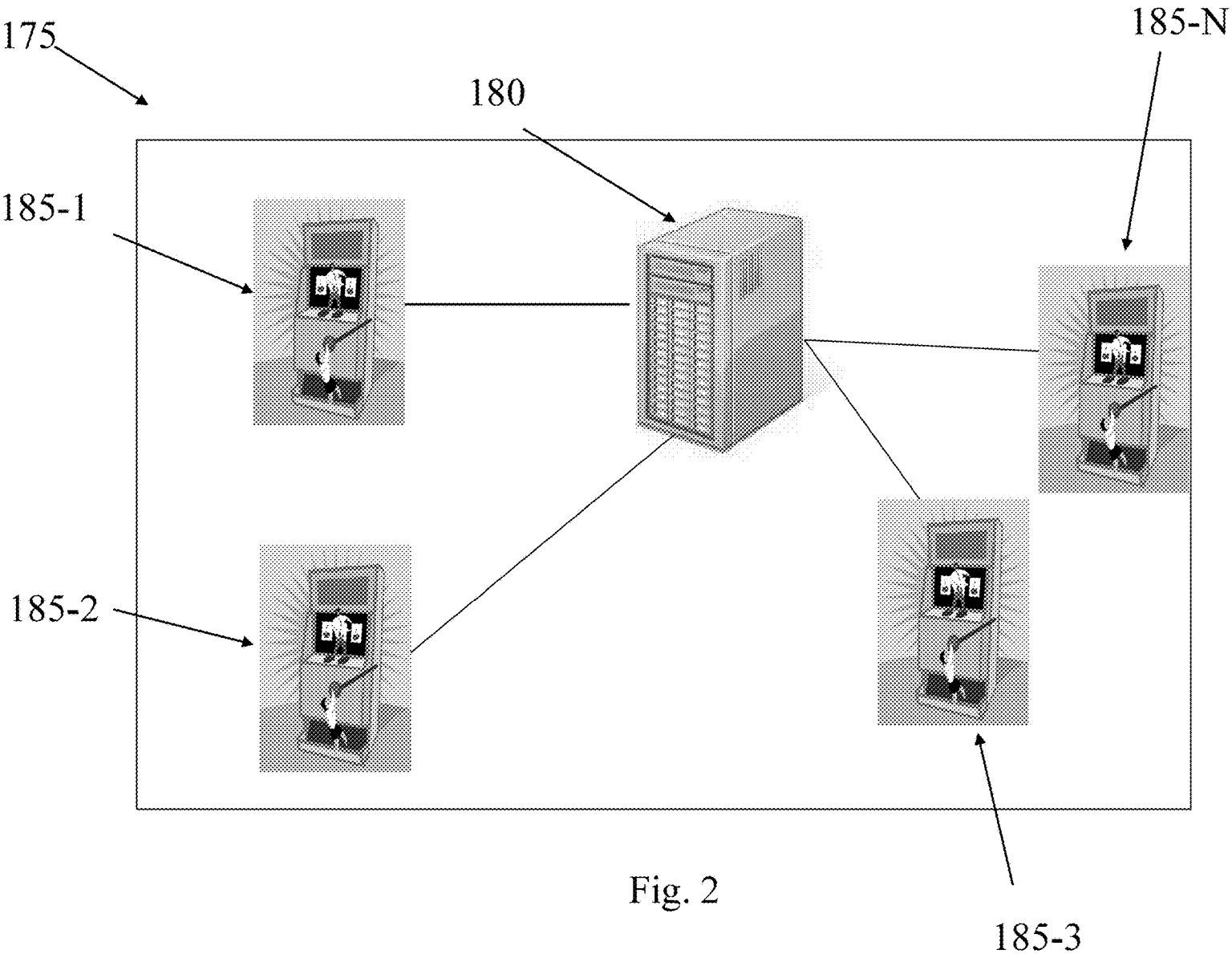
FIG. 2 illustrates a block diagram of a wired system of standalone gaming devices for conducting a casino game according to the embodiments of the present invention.

FIG. 2 shows a block diagram of a wired system 175 which may be used to facilitate play of the game according to the embodiments of the present invention. The wired system 175 comprises a central computer 180 running a casino management system or the like and including one or more processors and memory. Standalone gaming devices 185-1 through 185-N (e.g., video machines) configured to facilitate game play.

Figure 3:
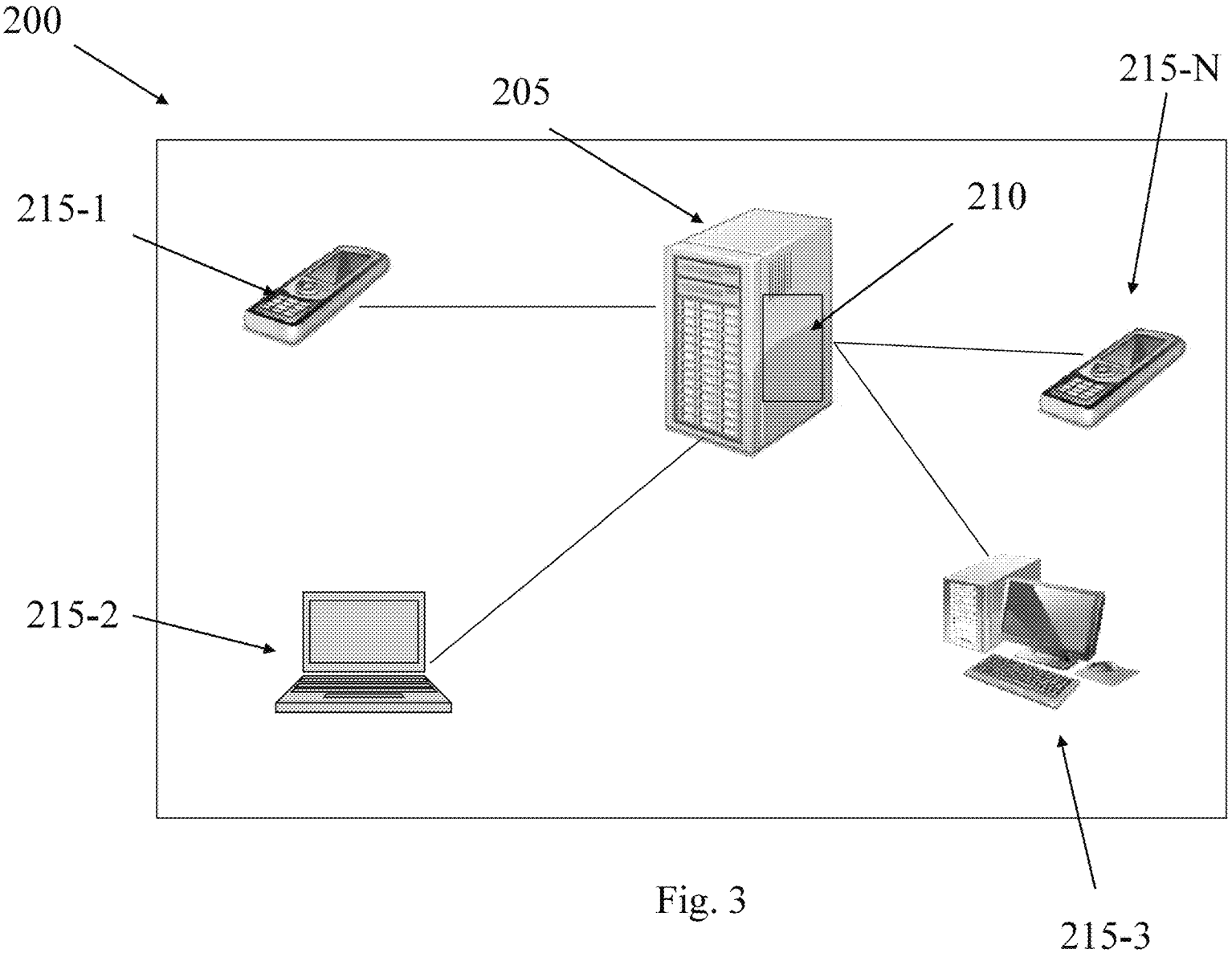
FIG. 3 illustrates a wireless system accessible by mobile devices for conducting a casino game according to the embodiments of the present invention.

FIG. 3 shows a block diagram of a wireless system 200 which may be used to facilitate remote play of the game according to the embodiments of the present invention. The wireless system 200 comprises a game server 205, including one or more processors 210 running game software, and remote devices 215-1 through 215-N (e.g., smart phones) configured to access said game server 205 facilitating game play on the remote devices 215-1 through 215-N. In another embodiment, the video game according to the embodiments of the present invention may be in the form of a software application ("App") downloadable onto smart phones, tablets or computers and playable via processing power and a user interface associated therewith. Wired connections may be used as well.

The embodiments of the present invention are directed to a player v. dealer card game having a comparison of declared player HI hands against a dealer's HI hand and declared player LO hands with a dealer's LO hand. Match and poker bonus features may also be incorporated to add excitement and player interest. In the embodiments detailed below, Aces have a value of 1 point when used in a LO hand and 11 when used in a HI hand, face cards have a value of 0 points and cards 2 through 10 have values equivalent with their rank. Other point systems may be used without departing from the spirit and scope of the present invention. Games may be played with 1 to 8 decks.

Figure 4A:
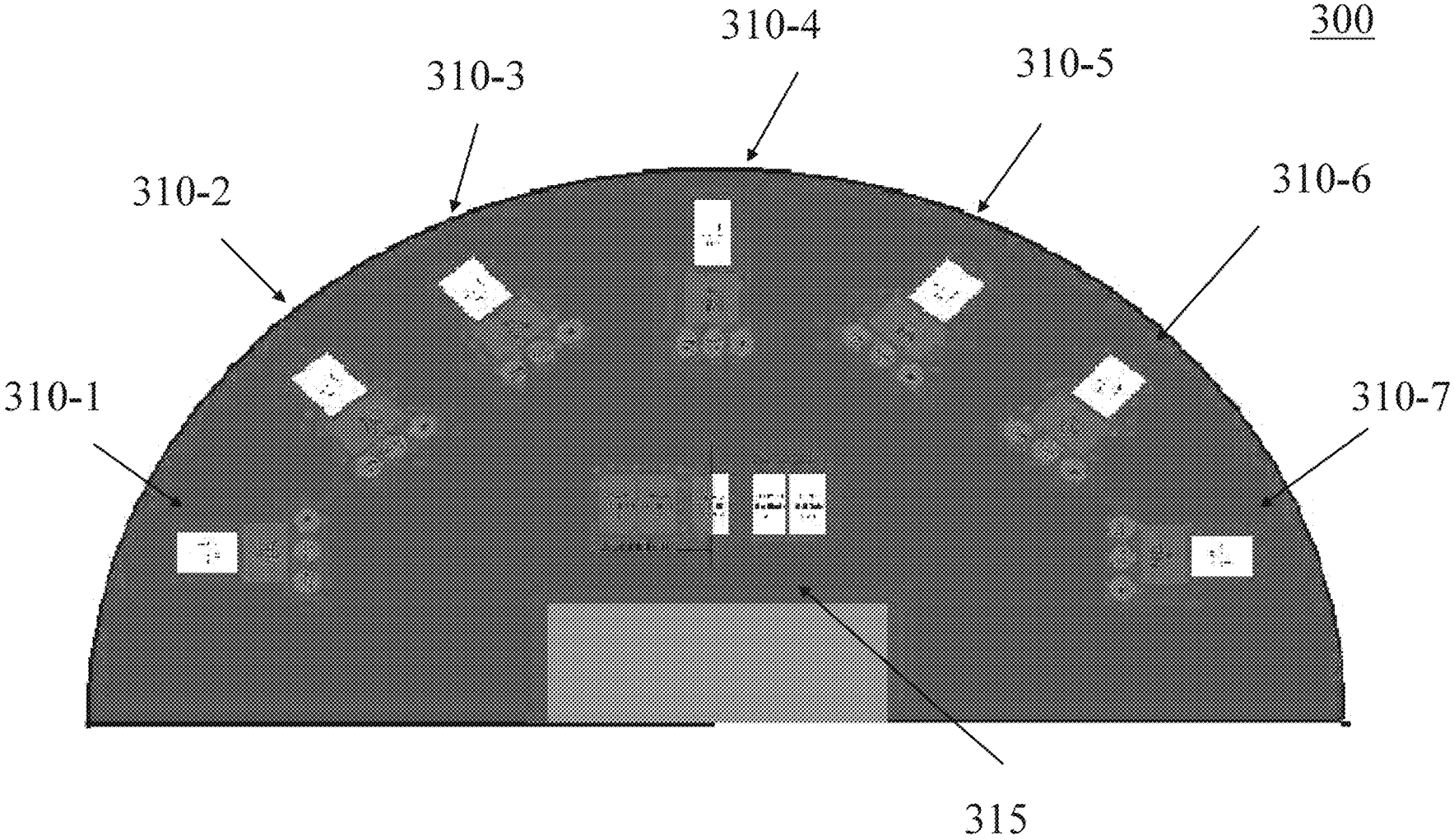
FIGS. 4A-4C illustrate a table layout for facilitating one embodiment of the present invention
Figure 4B:
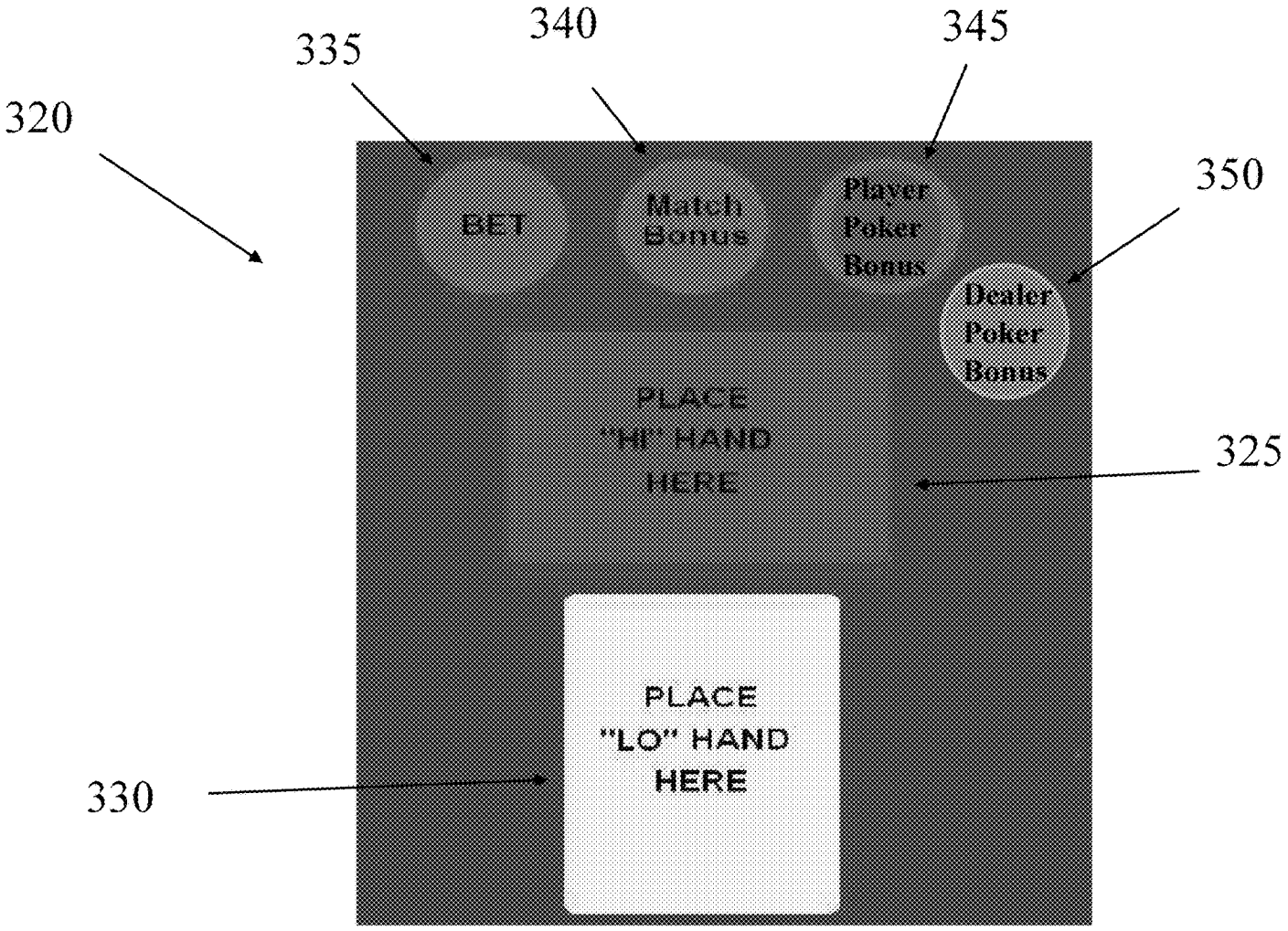
Figure 4C:
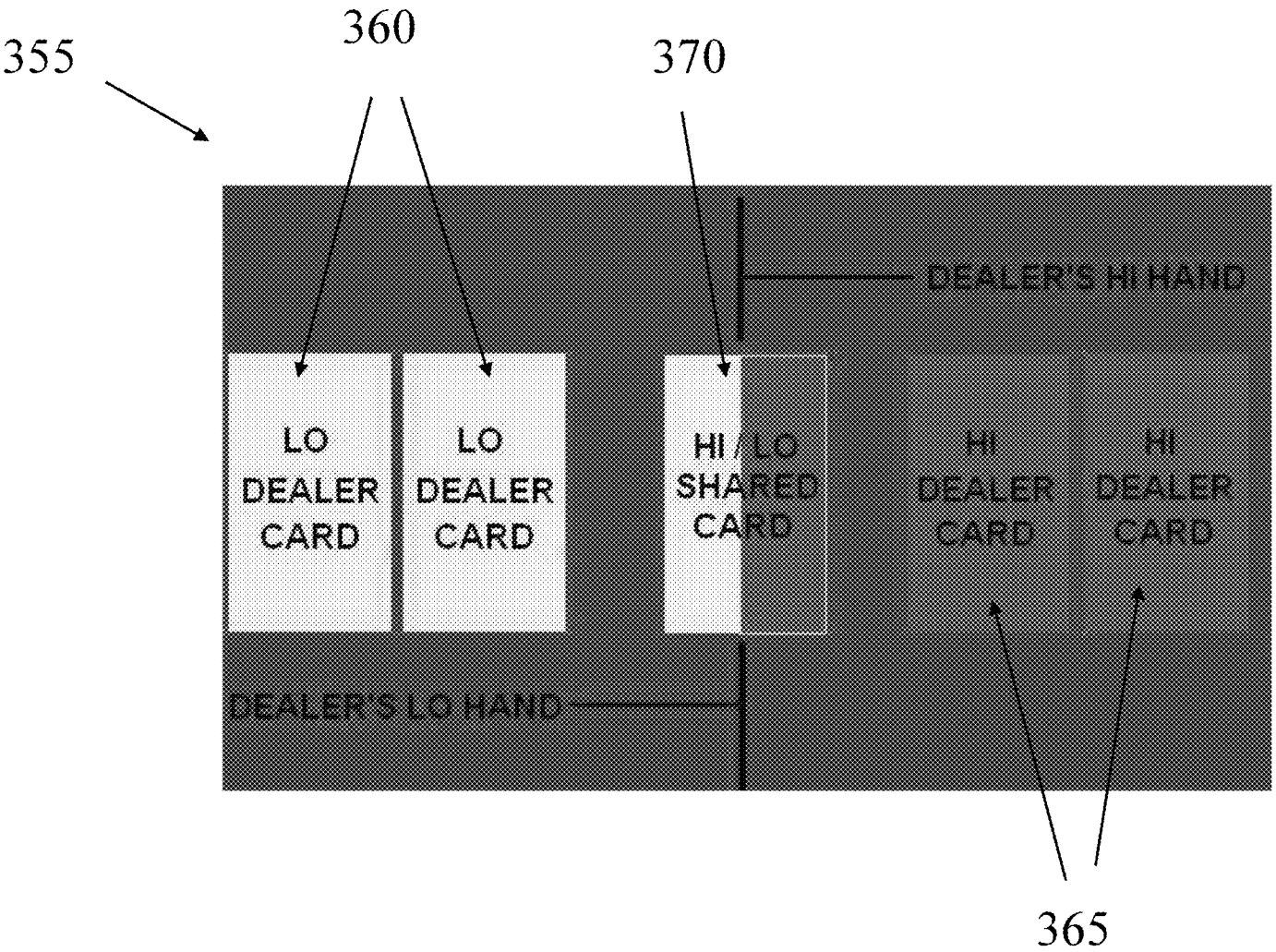
Figure 5:
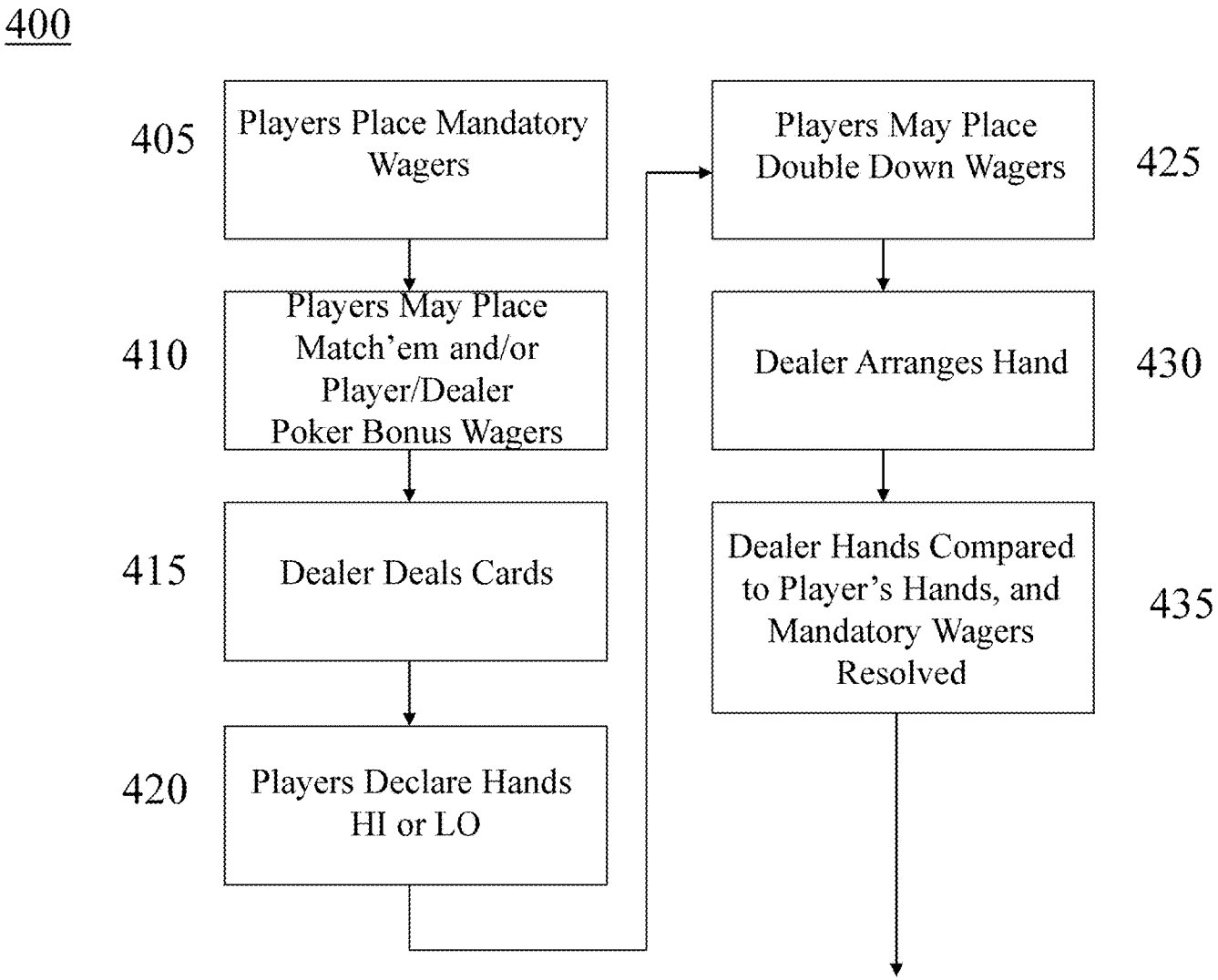
FIG. 5 illustrates a flow chart detailing an exemplary methodology associated with one embodiment of the present invention.
Figure 6:
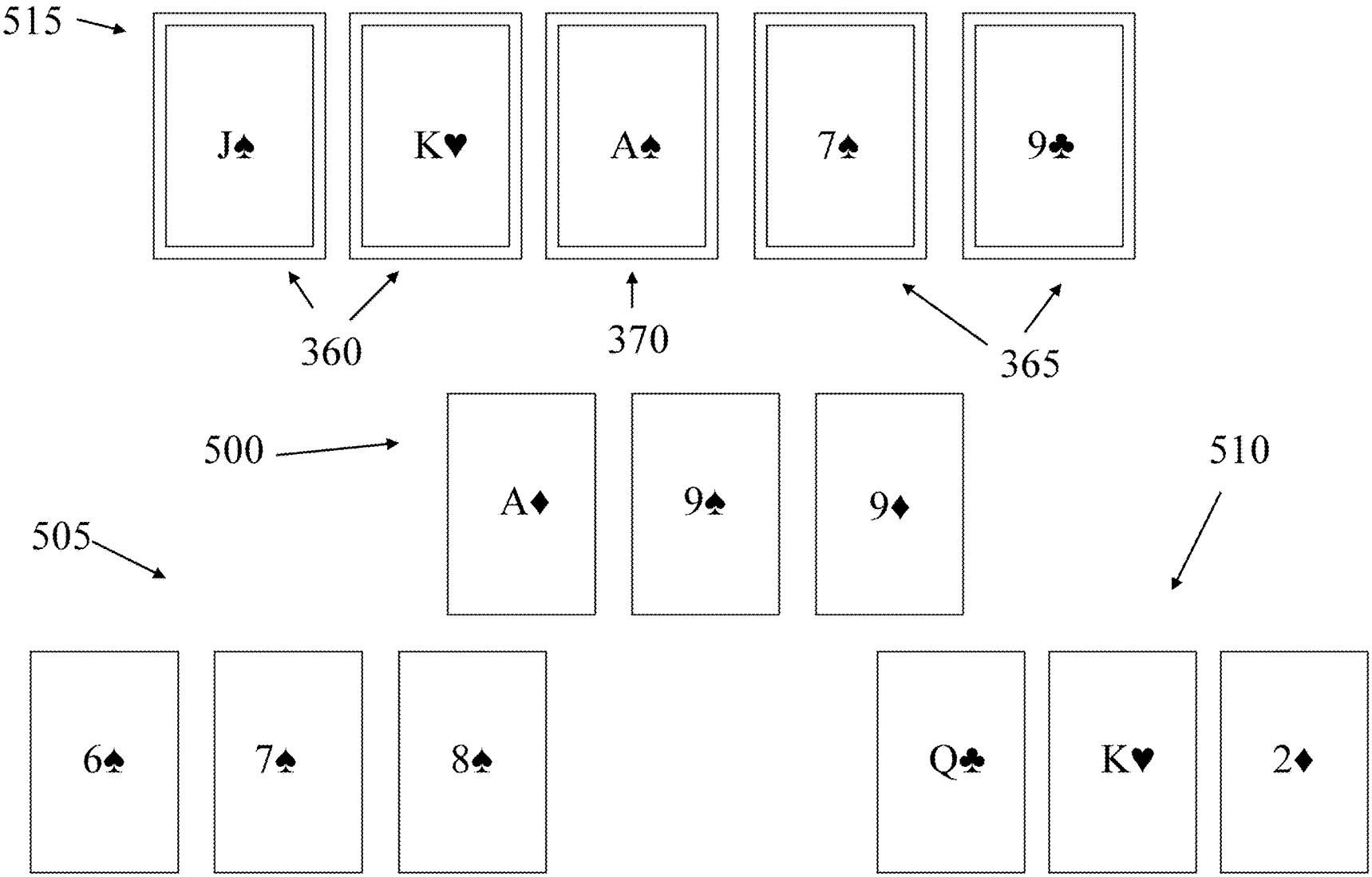
FIG. 6 illustrates a sample hand according to one embodiment of the present invention.

A first embodiment of the present invention is detailed relative to the exemplary layout 300 shown in FIG. 4A, detailed player and dealer areas shown in FIGS. 4B and 4C, flow chart 400 shown in FIG. 5 and sample hand 500 shown in FIG. 6. The layout 300 includes seven player areas 310-1 through 310-7 and a dealer area 315. Each of the seven player areas 310-1 through 310-7 includes identical player wager areas 320 which incorporate a HI hand area 325, LO hand area 330, mandatory game wager area 335, optional match wager area 340, player poker bonus wager area 345 and dealer poker bonus wager area 350. The dealer area 315 incorporates a dealer card placement area 355 comprising two LO card areas 360, two HI card areas 365 and a shared card area 370. The layout 300 is exemplary such that those skilled in the art will recognize that the layout 300 may be modified in any number of suitable ways.

Now referring to the flowchart 400 of FIG. 5, at 405, players place mandatory game wagers in the mandatory game wager area 335. The size of the wager is established by the casino or operator offering the game of chance. For example, the casino or operator may establish a suitable wager range as $5 to $500. At 410, optional match wagers, player poker bonus wagers and/or dealer poker bonus wagers may be placed by the players in the match wager area 340, player poker bonus wager area 345 and dealer poker bonus wager area 350, respectively. Again, the amounts of the optional match, player poker bonus wagers and dealer poker bonus wagers are established by the casino or operator. At 415, the dealer deals each player three face-down cards and the dealer five face-down cards. At 420, each player declares their hand as HI or LO by placing the cards into the HI hand area 325 or LO hand area 330. The declaration of HI or LO is based on the player's discretion and player's determination of which declaration provides the best opportunity to win. At 425, players may place an optional "double down" wager matching the amount of the mandatory game wager placed at 405. At 430, the dealer arranges his hand by determining his lowest possible three card point total from the five cards and placing the two lowest valued of the three cards in the two LO card areas 360 and places the remaining one of three lowest valued cards in the shared card area 370 and places the remaining two cards in the two HI card areas 365. In one embodiment, any Ace included in the three lowest valued cards must be placed in the shared card area 370. A dealer's LO hand and HI hand are comprised of the two cards in the LO card area 360 combined with the card in the shared card area 370, and the two cards in the HI card area 365 combined with the card in the shared card area 370, respectively. Thus, the card in the shared card area 370 forms part of the dealer's HI hand and LO hand. At 435, the dealer compares the dealer's LO hand to the hands of each player declaring a LO hand and the dealer's HI hand to the hands of each player declaring a HI hand, determines a winner and resolves the mandatory game wager. A winning HI hand is the hand with the higher value while a winning LO hand is the hand with a lower value. In one embodiment, ties are deemed a win for the player. At 440, it is determined whether the player placed a match wager. If not, the game advances to 445 to determine if the player placed a player or dealer poker bonus wager. If not, at 450, the game ends. If the player placed a match wager, at 455, the dealer makes a comparison of the dealer's five cards with the player's three cards to determine how many of the dealer's cards have a matching rank with any of the player's cards and, in one embodiment, at 460, match wagers are resolved according to a match pay table. Table 1 lists some exemplary payout schedules. At 465, losing match wagers (matching only 1 or 0 of the dealer's cards) are collected. Importantly, the steps of the flow chart 400 are exemplary only and can be performed in different orders than those shown.

TABLE 1

| # of Dealer Cards Matched | A1 | A2 | A3 |
|---|---|---|---|
| 5 | 100 | 80 | 100 |
| 4 | 25 | 25 | 30 |
| 3 | 4 | 4 | 3 |
| 2 | 1 | 1 | 1 |

If the player placed a player poker bonus wager, at 470, the dealer evaluates the player's three cards to determine a poker hand formed thereby. At 475, in one embodiment, player poker bonus wagers are resolved against a poker bonus pay table. Table 2 lists some exemplary payout schedules. At 480, losing poker bonus wagers are collected. Dealer poker bonus wagers are based on the poker hand formed by the dealer's five cards (see Table 3 for an exemplary payout schedule).

TABLE 2

| Player 3-card Winning Hands | B1 | B2 | B3 |
|---|---|---|---|
| Suited 3 of a Kind | 100 | 100 | 100 |
| Straight Flush | 25 | 30 | 30 |

TABLE 2-continued

| Player 3-card Winning Hands | B1 | B2 | B3 |
|---|---|---|---|
| 3 of a Kind | 15 | 12 | 10 |
| Straight | 4 | 4 | 4 |
| Suited Pair | 3 | 3 | 3 |
| Flush | 2 | 2 | 2 |
| One Pair | 1 | 1 | 1 |

TABLE 3

| Dealer 5-card Winning Hands | Payout |
|---|---|
| 5 of a Kind Suited | Grand Jackpot |
| Royal Flush | Major Jackpot |
| 4 of a Kind Suited | Minor Jackpot |
| Straight Flush | 500:1 |
| 5 of a Kind | 250:1 |
| 4 of a Kind | 100:1 |
| Full House | 25:1 |
| Flush | 15:1 |
| Straight | 10:1 |
| 3 of Kind | 5:1 |

FIG. 6 shows an exemplary game with three player's hands 500, 505 and 510 and a dealer's hand 515. In this example, each player has placed the mandatory game wager, and optional double down wager, match wager, player poker bonus wager and dealer poker bonus wager. Player's hand 500 comprises the A♦, 9♠ and 9+, player's hand 505 comprises the 6♠, 7♠ and 8♠, player's hand 510 comprises the Q♣, K♥ and 2♦, and dealer's hand 615 comprises the A♠, H♥, 9♣, J♠ and 7♠. The player holding hand 500 declares his or her hand HI with a point value of 29 and also decides to place the optional Double Down wager, the player holding hand 505 declares his or her hand HI with a point value of 21, but does not place the optional Double Down wager, the player holding hand 510 declares his or her hand LO with a point value of 2 and also decides to place the optional Double Down wager. The dealer then locates the three lowest-valued cards comprising the A♠ (1 point), K♥ (0 points) and J♠ (0 points) forming the LO hand with the A♠ placed in the shared card area 370, the K♥ and J♠ placed in the LO card areas 360, and the remaining cards, namely the 9♣ and 7♠ placed in the HI card areas 365. As set forth above, in one embodiment, an Ace forming part of the lowest three cards is always placed in the shared card area 370. As arranged, the dealer's HI hand value is 27 comprising the 9♣, A♠ and 7♠ (9+11+7) and the dealer's LO hand value is 1 comprising the K♥, A♠ and J♠ (0+1+0) with the A♠ included in both hands.

Player's hand 500 has a HI hand value of 29 which beats the dealer's HI hand value of 27 resulting in a win of the mandatory game wager and double down wager at an even money payout. The player holding hand 500 also wins the match wager because the rank of two of the dealer's cards (A♠ and 9♣) have been matched by the rank of cards in the player's hand (A♦ and, either the 9♠ and 9♦) resulting in two matches. The player holding hand 500 wins the player poker bonus wager since the player's hand includes a pair of 9*s* forming a winning poker hand as set forth in Table 2. Player's hand 505 has a HI hand value of 21 so the player loses his or her mandatory game wager (i.e., the dealer has the higher hand value of 27). The player holding hand 505 loses the match wager since the rank of only one dealer card (7♠) has been matched by the rank of any of the player's cards (7♠). The player holding hand 505 wins the player poker bonus wager because the player's three cards (6♠, 7♠ and 8♠) form a straight flush. Player's hand 510 has a LO hand value of 2 so the player loses his or her mandatory game wager and double down wager since the dealer's LO hand has a value of 1 point which is less than the player's LO hand value. The player holding hand 510 loses the match wager with only one match. The player holding hand 510 also loses the player poker bonus wager as his or her three cards do not form a winning poker hand according to Table 2. No player wins the dealer poker bonus wager as the dealer's five-card hand fails to meet the winning poker hands set forth in Table 3.

The embodiments of the present invention are suitable for live table games, utilizing playing cards or player terminals having displays which depict simulated playing cards and which may also permit electronic wagers to be made, electronic standalone gaming devices, networked electronic gaming devices and online games of chance. With an electronic embodiment, whether a standalone device or computer network with a server, a processor or similar device controls the game and a user interface such a keyboard, button panel or monitor having touch screen technology allows a player to play the game against a simulated dealer or remotely located dealer. The game may also be facilitated by a "App" downloadable onto a mobile device or desktop. These different technologies are well known to those skilled in the art such that they need not be detailed herein.

Although the invention has been described in detail with reference to several embodiments, additional variations and modifications exist within the scope and spirit of the invention as described and defined in the following claims.

We claim:

1. An electronically implemented method of conducting a card game on an electronic gaming device comprising:

providing a processor, a memory, a video display, and a user interface, said memory storing executable instructions, said executable instructions relating to the operation of said electronic gaming device instructions, said executable instructions relating to the operation of said electronic gaming device and executable by said processor to implement the steps of:

accepting mandatory game wagers via a currency or ticket reader or credit meter;

from a simulated deck of playing cards, displaying on said video display three random player's cards forming a player hand;

accepting, via said user interface, a player input declaring said player's hand as a player HI hand or player LO hand;

from said simulated deck of playing cards, displaying on said video display five random dealer's cards;

arranging two of said dealer's cards into a dealer's HI hand and two different of said dealer's cards into a dealer's LO hand and using a final dealer's card as a shared card to be the third card in both said dealer's HI hand and said dealer's LO hand thereby forming a dealer's three card HI hand and a dealer's three card LO hand;

determining a point value of said player's three cards and determining a point value for each of said dealer's HI and LO hands based on a rank of each card forming said player's HI hand or LO hand and said dealer's three card HI and three card LO hands wherein non-face cards have rank equal to the card rank and face cards have a rank of zero;

comparing a point value of a player's declared LO hand with a point value of said dealer's LO hand or a point value of said player's declared HI hand with a point value of said dealer's HI hand;

providing a payout relative to said mandatory game wagers responsive to said player's declared HI hand having a point value exceeding a point value of said dealer's HI hand or said player's declared LO hand having a point value below a point value of said dealer's LO hand; and collecting said mandatory game wagers responsive to said player's declared HI hand having a point value below a point value of said dealer's HI hand or said player's declared LO hand having a point value above a point value of said dealer's LO hand.

2. The method of claim 1 further comprising providing a payout relative to said mandatory game wagers to each player holding a declared player's HI hand having a point value equal to a point value of said dealer's HI hand and a declared player's LO hand having a point value equal to a point value of said dealer's LO hand.

3. The method of claim 1 further comprising offering a match wager based on a number of dealer's cards having ranks matching a player's cards.

4. The method of claim 1 further comprising offering a player poker bonus wager based on a poker hand formed with said three player's cards.

5. The method of claim 1 further comprising offering a dealer poker bonus wager based on a poker hand formed with said five dealer's player cards.

6. The method of claim 1 further comprising allowing players to place a secondary game wager double said mandatory game wager after players receive and declare the player's hand as HI or LO.

7. A non-transitory computer readable medium having stored thereon a computer program directed to a card game, said computer-readable medium causing an electronic gaming device having a processor, a memory, a video display, and a user interface to perform the steps of:

accepting mandatory game wagers via a currency or ticket reader or credit meter;

from a simulated deck of playing cards, displaying on said video display three random player's cards forming a player hand;

accepting, via said user interface, a player input declaring said player's hand as a player HI hand or player LO hand;

from said simulated deck of playing cards, displaying on said video display five random dealer's cards;

arranging two of said dealer's cards into a dealer's HI hand and two different of said dealer's cards into a dealer's LO hand and using a final dealer's card as a shared card to be the third card in both said dealer's HI hand and said dealer's LO hand thereby forming a dealer's three card HI hand and a dealer's three card LO hand;

determining a point value of said player's three cards and determining a point value for each of said dealer's HI and LO hands based on a rank of each card forming said player's HI hand or LO hand and said dealer's three card HI and three card LO hands; comparing a point value of a player's declared LO hand with a point value of said dealer's LO hand or a point value of said player's declared HI hand with a point value of said dealer's HI hand;

providing a payout relative to said mandatory game wagers responsive to said player's declared HI hand having a point value exceeding a point value of said dealer's HI hand or said player's declared LO hand having a point value below a point value of said dealer's LO hand; and collecting said mandatory game wagers responsive to said player's declared HI hand having a point value below a point value of said dealer's HI hand or said player's declared LO hand having a point value above a point value of said dealer's LO hand.

8. The non-transitory computer readable medium of claim 7 further comprising performing the step of: providing a payout relative to said mandatory game wagers to each player holding a declared player's HI hand having a point value equal to a point value of said dealer's HI hand and a declared player's LO hand having a point value equal to a point value of said dealer's LO hand.

9. The non-transitory computer readable medium of claim 7 further comprising performing the step of: offering a match wager based on a number of dealer's cards having ranks matching a player's cards.

10. The non-transitory computer readable medium of claim 7 further comprising performing the step of: offering a player poker bonus wager based on a poker hand formed with said three player's cards.

11. The non-transitory computer readable medium of claim 7 further comprising performing the step of: offering a dealer poker bonus wager based on a poker hand formed with said five dealer's player cards.

12. The non-transitory computer readable medium of claim 7 further comprising performing the step of: allowing players to place a secondary game wager double said mandatory game wager after players receive and declare the player's hand as HI or LO.

13. The non-transitory computer readable medium of claim 7 further comprising performing the step of: utilizing a point system wherein non-face cards have a rank equal to the card rank and face cards have a rank equal to zero.

* * * * *